United States Patent [19]

Rispin et al.

[11] 4,190,012

[45] Feb. 26, 1980

[54] FAIRED TOW CABLE WITH STUBS FOR STRUM REDUCTION

[75] Inventors: Peter P. Rispin, Washington, D.C.; Bruce L. Webster, Sterling, Va.; John Stasiewicz, Gaithersburg; Jesse S. Diggs, Rockville, both of Md.

[73] Assignee: The United States of America as represented by the Secretary of the Navy, Washington, D.C.

[21] Appl. No.: 973,988

[22] Filed: Dec. 28, 1978

Related U.S. Application Data

[63] Continuation of Ser. No. 690,348, May 27, 1976, abandoned.

[51] Int. Cl.[2] ..... F15D 1/10

[52] U.S. Cl. ..... 114/243

[58] Field of Search ..... 114/243, 244; 174/42, 174/70 R, 70 A, 27, 101.5, 117 R, 128; 188/1 B; 138/178; 73/147

[56] References Cited

U.S. PATENT DOCUMENTS

| | | | |
|---|---|---|---|
| 3,368,514 | 2/1968 | Kelly | 114/243 |
| 3,440,991 | 4/1969 | Cubbage | 114/243 |
| 3,472,196 | 10/1969 | Ewing et al. | 114/243 |
| 3,884,173 | 5/1975 | Fabula | 114/243 |
| 3,895,595 | 7/1975 | Kelly et al. | 114/243 |

*Primary Examiner*—Charles E. Frankfort
*Assistant Examiner*—Jesus D. Sotelo
*Attorney, Agent, or Firm*—R. S. Sciascia; Q. E. Hodges

[57] ABSTRACT

A cable fairing to reduce the "strumming" of a tow cable comprising a plurality of tabs or stubs, having a height radially of the cable, less than the cable diameter, extruded onto the armor sheath of the cable. The stubs are integrally formed in a thermal-setting plastic sheath in a spiral pattern of small angle along the length of the cable. The spiral pattern is reversed at periodic intervals, or two sets of tabs are provided and arranged in opposite-hand spiral patterns criss-crossing within the same cable length.

1 Claim, 2 Drawing Figures

FAIRED TOW CABLE WITH STUBS FOR STRUM REDUCTION

The invention described herein may be manufactured and used by or for the Government of the United States of America for governmental purposes without the payment of any royalties thereon or therefor.

This is a continuation of application Ser. No. 690,348 filed May 27, 1976, and now abandoned.

BACKGROUND OF THE INVENTION

The invention relates to underwater tow cables, and more particularly to the reduction of vibration of the cable, referred to as "strumming" that is used for towing various instruments by surface vessels. Prior art examples of the efforts to reduce strumming provide solid streamlined hydrofoil-shaped segments along the cable such as U.S. Pat. No. 3,443,020, but this is intended to be towed almost vertically, i.e., at a sharp angle to the flow direction. Other examples in the prior art use flexible fairings which ranged from flag-types of various widths, exemplified by U.S. Pat. Nos. 3,895,595 and 3,472,196, to ribbons or streamers shown in U.S. Pat. No. 3,895,595, to fins shown in U.S. Pat. No. 3,368,514, and to thrums and hair-like fairings exemplified by U.S. Pat. Nos. 3,368,514, 3,472,196 and 3,440,991 all assigned to the Government. Still another type of fairing uses a wire or plastic extrusion that forms a helical ridge or ridges along the tow cable. The disadvantages of these fairings are that some are effective only with cables towed at a sharp angle to the flow say over 20 degrees, but are not effective with cables towed at a small angle to the flow, typically 20 degrees or less. In particular, the solid hydrofoil is no longer streamlined to the flow, and the flag-types tend to fold over. The ribbon and hair-like fairings cause handling and storage problems resulting from reeling and unreeling them over rollers, sheaves, and winches. Such handling reduces the life of the fairings because many elements are ripped off the cable. The hydrofoil-faired cable is extremely cumbersome to handle and store. Also the helical fairing has been found to be quite dependent on the angle of flow, which obviously can vary considerably.

SUMMARY OF THE INVENTION

Briefly the instant invention overcomes the disadvantages of the prior art towed cable fairings by providing a fairing comprising small stiff stubs slightly protruding radially from the cable so that the long axis of each stub is at a small angle to the axis of the cable on a helical line. The helical pattern is reversed at periodic intervals, or two sets of stubs are provided and counterwound in opposite helical patterns in the same cable length to prevent twisting and sideways forces on the cable.

OBJECTS OF THE INVENTION

Accordingly, an object of the invention is to provide a new, improved, efficient, and reliable fairing for tow cables that reduces "strumming".

Another objective of the instant invention is to provide a fairing for a tow cable that is effective where the cable is towed at a small angle to the flow.

Still another object of the present invention is to provide a fairing for a tow cable that is easy to reel, unreel, and to store.

A still further object of the instant invention is to provide a fairing for a tow cable that is durable in handling for reeling, unreeling, and storing.

BRIEF DESCRIPTION OF THE DRAWINGS

A more complete understanding of the invention and many of the attendant advantages thereto will be apparent from the following detailed description when considered in conjunction with the accompanying drawings, wherein.

DESCRIPTION OF THE PREFERRED EMBODIMENT

Figure 1:
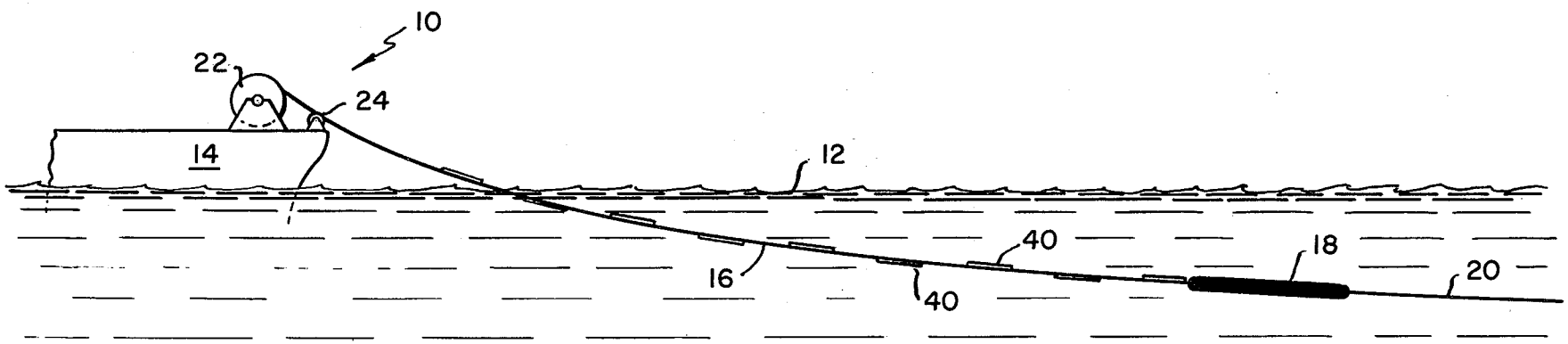
FIG. 1 is a diagrammatic illustration of a ship and the faired towing cable in use according to the invention.

Referring now to the drawings wherein like reference numerals refer to the same element throughout the several views, there is shown in FIG. 1 generally, a ship 10 afloat in a body of water 12. Attached at the stern 14 of the ship 10 is a cable 16 of considerable length connected to a towed underwater instrument or array 18. A rope drogue 20 may be attached at the aft of the array 18 to maintain its attitude under tow.

At the stern 14 of the ship 10, the faired cable 16 is wound on a motorized reel 22 and then over a fair-lead sheave or towpoint gimbal 24 that allows all tow angles and that insulates the cable from ship vibrations. The reel 22 and fairlead sheave are designed to readily handle the fairing stubs (to be discussed later) during reeling and unreeling.

Figure 2:
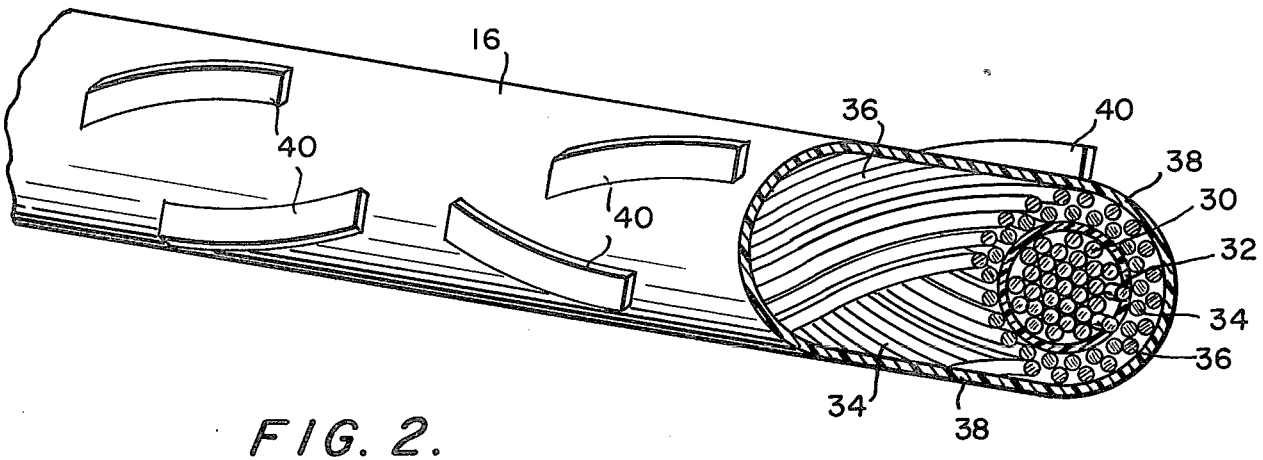
FIG. 2 is an enlarged fragmentary view of a portion of the tow cable with the fairing sheath applied to the cable.

Referring now to FIG. 2, a cross-section and perspective view is shown of the cable 16 which will be described from the inside out. A plurality (perhaps 27) of electrical conductors 30, each with individual insulation, form the core of the cable. Over the core of conductors 30 is an insulation sheath 32 holding the conductors together and precluding ingress of water. Outside of the insulation sheath is an inner cable armor 34 with a right-hand or left-hand lay. Outside the inner cable armor 34 is an outer cable armor 36 of the opposite-hand lay, which together eliminate the tendency of the cable to twist and unwrap during towing operations and of course, to carry the towing strain. Outside the outer cable armor 36, encasing the entire cable 16, is a fairing sheath 38 with fairing stubs 40, which may be integrally formed for example. The fairing sheath may be made of a thermal setting plastic, or the like, and may be applied by the normal extruding method during cable manufacture. The extrusion die would include dies to form the stubs 40.

As is best shown in FIG. 2 the fairing stubs 40 of the preferred embodiment are best described as having a height, radially of the cable, of approximately $\frac{1}{4}$ of a cable diameter, e.g., $\frac{1}{8}''$ high for a $\frac{1}{2}''$ diameter cable and $\frac{1}{4}''$ high for a 1" diameter cable. It has been found that a stub thickness of 0.015" to 0.030" is desirable for stiffness under most towing conditions. The stubs are from 1 to 2 cable diameters in length, and affixed to the fairing sheath surface so that the long axis of each stub is at a small angle to the axis of the cable. The length of the stubs are placed on the fairing sheath in criss-cross, opposite-hand patterns along counterwound helical lines, the pitch-to-cable diameter ratio of which are approximately 15:1 to 30:1. Pitch is defined as the length along the cable in which the helix makes a complete revolution. It is termed a ratio to cable diameter, e.g., a pitch-to-cable diameter ratio of 15:1 for a 1" diameter cable means the helix makes one revolution in 15". The spacing between each stub on the helical line can vary from zero to two or three cable diameters. The criss-crossing, opposite-hand, helical patterns of the stubs substantially eliminate transverse cable vibration excursions, known as "strumming", because they interact with the flow in the cable boundary layer, thereby interfering with and reducing coherent vortex shedding.

Obviously, many modifications and variations of the present invention are possible in light of the above teachings. It is therefore to be understood that within the scope of the appended claims, the invention may be practiced otherwise than as specifically described.

What is claimed is:

1. Fairing means on the periphery of a towing cable for reducing strumming vibrations induced in the cable as it is towed generally longitudinally of its length through water comprising:

a plurality of discontinuous elongate stubs longitudinally spaced apart from one another along respective coextensive right hand and left hand helical paths which criss-cross one another about the periphery of the cable.

* * * * *